US008955786B2

(12) United States Patent
Motoji et al.

(10) Patent No.: US 8,955,786 B2
(45) Date of Patent: Feb. 17, 2015

(54) DEVICE FOR TAKING UP FIRE-FIGHTING HOSE AND METHOD FOR TAKING UP FIRE-FIGHTING HOSE

(75) Inventors: Yoshitaka Motoji, Yoshida-gun (JP); Yoshinori Motoji, Yoshida-gun (JP); Takashi Hasegawa, Fukui (JP)

(73) Assignees: Yoshitaka Motoji, Fukui (JP); Eikan Shoji Co., Ltd., Fukui (JP)

( * ) Notice: Subject to any disclaimer, the term of this patent is extended or adjusted under 35 U.S.C. 154(b) by 263 days.

(21) Appl. No.: 13/393,400

(22) PCT Filed: Sep. 8, 2010

(86) PCT No.: PCT/JP2010/005505

§ 371 (c)(1),
(2), (4) Date: Feb. 29, 2012

(87) PCT Pub. No.: WO2011/030545

PCT Pub. Date: Mar. 17, 2011

(65) Prior Publication Data

US 2012/0153067 A1 Jun. 21, 2012

(30) Foreign Application Priority Data

Sep. 9, 2009 (JP) ..... 2009-208447

(51) Int. Cl.
*B65H 75/40* (2006.01)
*B65H 75/48* (2006.01)
(Continued)

(52) U.S. Cl.
CPC ..... *A62C 33/04* (2013.01); *B65H 54/585* (2013.01); *B65H 2701/332* (2013.01)
USPC ..... 242/391.2; 242/403.1; 242/391.3; 242/557; 137/355.26

(58) Field of Classification Search
CPC ..... B65H 54/585; B65H 75/403; B65H 2405/422; B65H 2701/33; B65H 19/28; B65H 75/4497; A62C 33/04
USPC ..... 242/403, 403.1, 402, 557, 530.2, 532.5, 242/532.6, 532.7, 546.1, 388, 388.1, 388.5, 242/395, 391, 391.2, 391.3; 137/355.16, 137/355.19, 355.26; 254/323
See application file for complete search history.

(56) References Cited

U.S. PATENT DOCUMENTS 190,231 A * 5/1877 McGaffey ..... 242/403.1
763,340 A * 6/1904 Brandon ..... 242/391.3
(Continued)

FOREIGN PATENT DOCUMENTS

JP 2-98960 8/1990
JP 6-171834 A 6/1994
(Continued)

OTHER PUBLICATIONS

International Search Report for PCT/JP2010/005505, ISA/JP, mailed Oct. 26, 2010.

*Primary Examiner* — Emmanuel M Marcelo
*Assistant Examiner* — Michael Gallion
(74) *Attorney, Agent, or Firm* — Harness, Dickey & Pierce, PLC

(57) ABSTRACT

A device for taking up a fire-fighting hose, allowing the user to quickly and reliably take up the hose with a small force in an upright posture and capable of accurately taking up the hose both in a single layer and in double layers. Wheels (2) are rotatably supported at the lower part of a frame body (1), and a handle (5) is provided to the upper part of the frame body (1). The frame body (1) can be moved by rotating the wheels (2) by pushing or pulling the handle (5). A rotatable reel (3) on which hose (H) is wound is provided to the frame body (1), a power transmitting circulation member (4) is passed over the rotating shaft (33) of the reel (3) and the rotation support shaft (21) of the wheels (2) to enable the reel (3) to rotate in association with the rotation of the wheels (2). A core member (3A) for a single-layer winding and a core member (3B) for double-layer winding, which are interchangeable, are provided to the reel (3), and either the core member (3A) for a single-layer winding or the core member (3B) for double-layer winding can be removably affixed to a rotating shaft section (30*a*) of a base plate (30) of the reel (3).

1 Claim, 12 Drawing Sheets

(51) Int. Cl.
*A62C 33/04* (2006.01)
*B65H 54/58* (2006.01)

(56) References Cited

U.S. PATENT DOCUMENTS

| | | | | | |
|---|---|---|---|---|---|
| 1,458,861 | A | * | 6/1923 | Springowski | 242/391.2 |
| 1,545,546 | A | * | 7/1925 | Brittin | 242/391.2 |
| 2,016,625 | A | * | 10/1935 | Carrier | 242/391.2 |
| 2,498,609 | A | * | 2/1950 | Reil | 56/16.7 |
| 3,473,755 | A | * | 10/1969 | Brown | 242/391 |
| 3,504,866 | A | * | 4/1970 | Palynchuk et al. | 242/399.1 |
| 3,529,786 | A | * | 9/1970 | Holden | 242/388.1 |
| 4,198,010 | A | * | 4/1980 | Knapp | 242/532.6 |
| RE32,510 | E | * | 9/1987 | Tisbo et al. | 137/355.27 |
| 4,723,568 | A | * | 2/1988 | Adams | 137/355.17 |
| 4,886,409 | A | * | 12/1989 | Penner | 414/24.6 |
| 4,892,265 | A | * | 1/1990 | Cox | 242/539 |
| 5,213,278 | A | * | 5/1993 | Holbek et al. | 156/497 |
| 5,273,257 | A | * | 12/1993 | Perkins | 254/375 |
| 5,388,609 | A | * | 2/1995 | Ghio et al. | 137/355.27 |
| 5,957,400 | A | * | 9/1999 | Brannen | 242/391 |
| 5,988,552 | A | * | 11/1999 | Tisbo et al. | 242/403.1 |
| 6,561,449 | B2 | * | 5/2003 | Lindermeir et al. | 242/391.2 |
| 6,591,744 | B2 | * | 7/2003 | Peek | 100/171 |
| 7,152,672 | B1 | * | 12/2006 | Gipson | 166/77.2 |
| 7,398,979 | B2 | * | 7/2008 | Yu Chen | 280/47.24 |
| 7,448,110 | B2 | * | 11/2008 | Best et al. | 15/40 |
| 7,628,350 | B2 | * | 12/2009 | Dethier | 242/403 |
| 7,661,683 | B2 | * | 2/2010 | Fernandez | 280/47.24 |
| 7,954,747 | B2 | * | 6/2011 | Chudy et al. | 242/533.8 |
| 8,464,974 | B2 | * | 6/2013 | Schillo | 242/557 |
| 2004/0089761 | A1 | * | 5/2004 | Tsao | 242/530.2 |
| 2004/0099760 | A1 | * | 5/2004 | Laporta | 242/395 |
| 2009/0166463 | A1 | * | 7/2009 | Mosher | 242/403.1 |
| 2009/0308964 | A1 | * | 12/2009 | Chudy et al. | 242/412.1 |
| 2010/0187348 | A1 | * | 7/2010 | Sato et al. | 242/554.2 |

FOREIGN PATENT DOCUMENTS

| | | | |
|---|---|---|---|
| JP | 2003-70931 | A | 3/2003 |
| JP | 3125700 | Y1 | 9/2006 |
| JP | 2009-196815 | A | 9/2009 |

* cited by examiner

DEVICE FOR TAKING UP FIRE-FIGHTING HOSE AND METHOD FOR TAKING UP FIRE-FIGHTING HOSE

CROSS-REFERENCE TO RELATED APPLICATIONS

This application is a 371 U.S. National Stage of International Application No. PCT/JP2010/005505, filed Sep. 8, 2010. This application claims the benefit of Japanese Patent Application No. JP2009-208447, filed Sep. 9, 2009. The entire disclosures of the above applications are incorporated herein by reference.

TECHNICAL FIELD

The present invention relates to an improvement of a take-up device for a fire-fighting hose and of a method of taking up a fire-fighting hose. More particularly, the present invention relates to a take-up device for a fire-fighting hose and a method of taking up a fire-fighting hose using the take-up device, which enable the hose to be quickly and reliably taken up in an upright posture with less effort and enable, with high accuracy, both a single-layer rolling operation and a double-layer rolling operation as take-up operations for the hose.

BACKGROUND ART

As is well known, a fire-fighting hose needs to be quickly restored on site after fire-fighting activities. In such a hose restoring operation, it is difficult to treat the hose because the hose has become heavier by becoming wet and has been tainted by adhesion of particles of oily smoke, petroleum oils, dirt, and the like. In addition, in many cases, the restoring operation is performed in a half-crouching posture, which involves heavy physical burden, and hence is markedly heavy labor.

Further, the hose that has been restored from the site also needs to be stored for next use after being brought back to a fire station and the like and then washed and dried.

However, there are two take-up methods as a method of taking up a hose. In order to restore the hose from the site, there is used a method of "single-layer rolling" in which the hose is taken up over the entire length from one end portion of the hose. In order to store the hose at a predetermined position, there is used a method of "double-layer rolling" in which the hose is doubled over substantially at a center thereof and taken up toward the end portion, with the folded part as a central axis, so that the hose is quickly and easily released at the time of use.

Conventionally, as a device for performing such a hose-restoring operation, there has been disclosed a carriage-type device to be self-propelled to take up a hose (for example, refer to Patent Document 1).

However, conventional restoring devices of this type include only one of a single-layer take-up mechanism and a double-layer take-up mechanism. Thus, it is inconvenient in that take-up devices need to be selectively used in a case of restoring the hose on site and in a case of taking up the hose for storing the same.

Further, those restoring devices are supported by four wheels, and hence smooth traveling of the restoring device cannot be carried out in bumpy places such as a fire-fighting site. Thus, those restoring devices are poor in usability, and have a problem that the hose cannot be neatly rolled around a reel owing to vibration.

CITATION LIST

Patent Document

Patent Document 1: Japanese Utility Model Registration No. 3125700 (pages 4 to 5, FIGS. 1 to 4)

SUMMARY OF INVENTION

Technical Problems

The present invention has been made in view of the above-mentioned problems of conventional hose take-up devices. It is an object of the present invention to provide a take-up device for a fire-fighting hose, which enables the hose to be quickly and reliably taken up in an upright posture with less effort and enables both take-up methods: single-layer rolling and double-layer rolling of the hose, to be performed with high accuracy. It is another object of the present invention to provide a method of taking up a fire-fighting hose, in which the hose can be smoothly taken up with use of the take-up device.

Solution to Problems

In the following, with reference to accompanying figures, description is made of measures which the inventors of the present invention have employed for solving the above-mentioned technical problems.

That is, the present invention provides a take-up device for a fire-fighting hose, for taking up and restoring a long hose H including couplers C respectively arranged at both a leading end portion and a trailing end portion thereof, the take-up device including:

a wheel 2 pivotably supported at a lower portion of a frame unit 1;

a handle 5 arranged at an upper portion of the frame unit 1, the handle 5 being pushed and drawn so that the wheel 2 is rotated and the frame unit 1 is allowed to be transferred;

a rotatable reel 3 provided to the frame unit 1 and around which the hose H is rolled up; and a transmission circulating member 4 looped around a rotary shaft 33 of the reel 3 and a rotational support shaft 21 of the wheel 2, in which the reel 3 is rotatable in association with the rotation of the wheel 2, in which the reel 3 includes a single-layer-roll core 3A and a double-layer-roll core 3B replaceable with each other, any one of the single-layer-roll core 3A and the double-layer-roll core 3B being capable of being removably fixed to a rotary-shaft portion 30*a* of a base plate 30 of the reel 3, in which the single-layer-roll core 3A includes a holding member 31A capable of pinching one of the couplers C arranged at the end portions of the hose H, the hose H being capable of being rolled up around the single-layer-roll core 3A by rotation of the reel 3, with the one of the couplers C, which is pinched by the holding member 31A, being a central axis, in which the double-layer-roll core 3B includes a projecting shaft 31B provided to project therefrom and a hook bar 32B provided near and in parallel with the projecting shaft 31B, the hose H being capable of being rolled up around the double-layer-roll core 3B while being looped around the projecting shaft 31B and the hook bar 32B by the rotation of the reel 3 under a state in which a fold f formed by doubling over the hose H is hooked to the hook bar 32B, with the projecting shaft 31B being a rotary shaft, and in which an extended guide plate 30*b* is provided to extend from the base plate 30 of the reel 3, the hose H being capable of being rolled up by passing a hose guide 6 arranged on a front side of the frame unit 1 and then being led to the reel 3, with a side edge of the hose H being held in abutment with a surface of the extended guide plate 30*b*. Thus, by adopting the technical measure as described above, the take-up device for a fire-fighting hose is completed.

Further, in order to solve the above-mentioned problems, in addition to the above-mentioned measure, when necessary, the present invention may adopt the following technical measure in which, on the rotary shaft 33 of the reel 3, a large-diameter sprocket 41A corresponding to the single-layer-roll core 3A and a small-diameter sprocket 41B corresponding to the double-layer-roll core 3B are removable to another end side of the rotary shaft 33, and corresponding combinations thereof are distinguishable from each other.

Still further, in order to solve the above-mentioned problems, in addition to the above-mentioned measures, when necessary, the present invention may adopt the following technical measure in which the hook bar 32B of the double-layer-roll core 3B of the reel 3 is formed into a tapered shape toward a leading end so that the hose H can be easily pulled out after having been taken up.

Still further, in order to solve the above-mentioned problems, in addition to the above-mentioned measures, when necessary, the present invention may adopt the following technical measure in which the frame unit 1 includes a leading inclined member 7 for bringing the hose H that has passed the hose guide 6 toward the extended guide plate 30*b* of the reel 3.

Still further, in order to solve the above-mentioned problems, in addition to the above-mentioned measures, when necessary, the present invention may adopt the following technical measure in which the reel 3 has a pair of recessed portions 30*c* and 30*c* formed near the rotary-shaft portion 30*a* of the base plate 30 of the reel 3 so that the hose H can be easily removed by fitting fingers into the recessed portions 30*c* and 30*c* after the hose H has been taken up.

Still further, in order to solve the above-mentioned problems, in addition to the above-mentioned measures, when necessary, the present invention may adopt the following technical measure which further includes a ratchet mechanism for transmitting rotation only in one direction of the wheel 2 to the reel 3.

Still further, in order to solve the above-mentioned problems, in addition to the above-mentioned measures, when necessary, the present invention may adopt the following technical measure in which the wheel 2 includes two wheels 2 and 2 arranged in pairs of left and right.

Still further, in order to solve the above-mentioned problems, in addition to the above-mentioned measures, when necessary, the present invention may adopt the following technical measure in which the rotational support shaft 21 of the wheel 2 includes a step portion 21*a*, and in which the hose guide 6 can be raised by placing a foot on the step portion 21*a* to fix the wheel 2, and tilting the handle 5 down about the rotational support shaft 21 as a rotary shaft.

Still further, in order to solve the above-mentioned problems, in addition to the above-mentioned measures, when necessary, the present invention may adopt the following technical measure in which the frame unit 1 includes a beam portion 11 and a stand member 11*b* provided at a leading end of the beam portion 11.

Still further, in order to solve the above-mentioned problems, in addition to the above-mentioned measures, when necessary, the present invention may adopt the following technical measure in which the rotational speed of the wheel 2 and the take-up speed for the hose are linked to each other through control of the rotational speed of the reel 3 to increase and decrease in accordance with an increase and a decrease of a diameter of a taken-up part of the hose H with use of a planetary roller, to thereby eliminate the need to replace two types of the sprockets corresponding to the large-diameter sprocket 41A and the small-diameter sprocket 41B.

Still further, in order to solve the above-mentioned problems, in addition to the above-mentioned measures, when necessary, the present invention may adopt the following technical measure in which the beam portion 11 arranged on the front side of the frame unit 1 is capable of being disassembled and removed, or is foldable.

Still further, in order to solve the above-mentioned problems, in addition to the above-mentioned measures, when necessary, the present invention may adopt the following technical measure in which the wheels 2 and 2 respectively include a free wheel 2A rotatably and pivotably supported and an associative wheel 2B coupled to the transmission circulating member 4 so that rotational torque of the wheel can be transmitted, the free wheel 2A and the associative wheel 2B being provided at respective end portions of the rotational support shaft 21.

Still further, in order to solve the above-mentioned problems, in addition to the above-mentioned measures, when necessary, the present invention may adopt the following technical measure which further includes a clutch mechanism in which at least a part of a drive unit is separable, the clutch mechanism enabling transmission of the rotational torque of the wheel 2 with respect to the reel 3 to be manually interrupted and established.

Note that, in the above-mentioned measure, the present invention may adopt the following technical measure which further includes a torque limiter mechanism which detects tension load equal to or more than a predetermined value, the tension load being generated by the inherent weight or friction of a part of the hose H, the part having not yet been taken up, and separates at least the part of the drive unit so that the transmission of the rotational torque of the wheel 2 with respect to the reel 3 is interrupted/established by spinning.

Still further, in order to solve the above-mentioned problems, in addition to the above-mentioned measures, when necessary, the present invention may adopt the following technical measure in which the rotary-shaft portion 30*a* includes rotary-shaft portions 30*a* and 30*a* provided at two points on the base plate 30 of the reel 3 so that the single-layer-roll core 3A and the double-layer-roll core 3B can be fixed respectively to the rotary-shaft portions 30*a* and 30*a* and that a link member 42 is looped around the rotary shafts 33 and 33 of the single-layer-roll core 3A and the double-layer-roll core 3B on rear surfaces of the rotary-shaft portions 30*a* and both rotary shaft portions are coupled to each other so as to be rotated in a linked manner.

Still further, in order to solve the above-mentioned problems, in addition to the above-mentioned measures, when necessary, the present invention may adopt the following technical measure in which the rotary-shaft portions 30*a* and 30*a* capable of respectively fixing the single-layer-roll core 3A and the double-layer-roll core 3B are provided, in which each of the rotary-shaft portions 30*a* of the base plate 30 are provided with a plurality of hole portions, in which engaging projecting portions 34A and 34A (34B and 34B) and the rotary shaft 33 are provided to project from each rear surface of the single-layer-roll core 3A and the double-layer-roll core 3B, and in which the rotary shaft 33 is inserted into a center of the rotary-shaft portion 30*a* and the engaging projecting portions 34A and 34A (34B and 34B) are engaged by rotation into the plurality of hole portions provided through the rotary-shaft portion 30*a*, the plurality of hole portions each including an elongated hole having an arc shape, thereby enabling fixing by fastening in a bayonet style.

Further, the present invention provides a method of taking up a fire-fighting hose, in which a long hose H including couplers C respectively arranged at both a leading end portion and a trailing end portion thereof is taken up and restored, the method including:

pivotably supporting a pair of wheels 2 (2A and 2B) at both ends of a rotational support shaft 21 at a lower portion of a frame unit 1, the wheels 2 and 2 respectively including a free wheel 2A rotatably and pivotably supported and an associative wheel 2B coupled to a transmission circulating member 4 so that rotational torque of the wheels can be transmitted, the free wheel 2A and the associative wheel 2B being provided at respective end portions of the rotational support shaft 21;

pushing and drawing a handle 5 arranged at an upper portion of the frame unit 1 so that the wheel 2 is rotated and the frame unit 1 can be moved;

providing, to the frame unit 1, a rotatable reel 3 around which the hose H is rolled up;

looping the transmission circulating member 4 around a rotary shaft 33 of the reel 3 and a rotational support shaft 21 of the wheel 2, the reel 3 being rotatable in association with the rotation of the wheel 2;

removably fixing any one of a single-layer-roll core 3A and a double-layer-roll core 3B to a rotary-shaft portion 30*a* of a base plate 30 of the reel 3, the single-layer-roll core 3A and the double-layer-roll core 3B being provided to the reel 3 and replaceable with each other;

rotating the reel 3 so that the hose H can be rolled up around the single-layer-roll core 3A, with one of the couplers C arranged at the end portions of the hose H being a central axis, the one of the couplers C being pinched by a holding member 31A provided to the single-layer-roll core 3A and capable of pinching the one of the couplers C;

rotating, with a projecting shaft 31B being a rotary shaft, the reel 3 under a state in which a fold f formed by doubling over the hose H is hooked to a hook bar 32B so that the hose H can be rolled up around the double-layer-roll core 3B while being looped around the projecting shaft 31B and the hook bar 32B, the projecting shaft 31B being provided to project from the double-layer-roll core 3B, the hook bar 32B being provided near and in parallel with the projecting shaft 31B; and providing an extended guide plate 30*b* to extend from the base plate 30 of the reel 3 so that the hose H can be rolled up by passing a hose guide 6 arranged on a front side of the frame unit 1 and then being led to the reel 3, with a side edge of the hose H being held in abutment with a surface of the extended guide plate 30*b*, tensioning the hose H in the front of the take-up device after the hose H has been taken up by a predetermined length and an outer circumference of a taken-up part of the hose H has become larger than unit circumferences of the wheels 2A and 2B;

lifting off the associative wheel 2B under a state in which the opposite free wheel 2A rotatably and pivotably supported by the rotational support shaft 21 is grounded;

temporarily stopping take-up operation performed by the reel 3 after moving forward the take-up device in a lifted-off state so that a tensioned state of the hose H is cancelled; and returning the tensioned hose H into a loose state by grounding the associative wheel 2B and moving forward the take-up device again, to thereby take up the hose H. Thus, by adopting the technical measure as described above, the method of taking up a fire-fighting hose is completed.

Still further, the present invention provides a method of taking up a fire-fighting hose, in which a long hose H including couplers C respectively arranged at both a leading end portion and a trailing end portion thereof is taken up and restored, the method including:

pivotably supporting a pair of wheels 2 and 2 at both ends of a rotational support shaft 21 at a lower portion of a frame unit 1;

pushing and drawing a handle 5 arranged at an upper portion of the frame unit 1 so that the wheel 2 is rotated and the frame unit 1 is movable;

providing, to the frame unit 1, a rotatable reel 3 around which the hose H is rolled up;

looping a transmission circulating member 4 around a rotary shaft 33 of the reel 3 and the rotational support shaft 21 of the wheel 2, the reel 3 being rotatable in association with the rotation of the wheel 2;

removably fixing any one of a single-layer-roll core 3A and a double-layer-roll core 3B to a rotary-shaft portion 30*a* of a base plate 30 of the reel 3, the single-layer-roll core 3A and the double-layer-roll core 3B being provided to the reel 3 and replaceable with each other;

rotating the reel 3 so that the hose H can be rolled up around the single-layer-roll core 3A, with one of the couplers C arranged at the end portions of the hose H being a central axis, the one of the couplers C being pinched by a holding member 31A provided to the single-layer-roll core 3A and capable of pinching the one of the couplers C;

rotating, with a projecting shaft 31B being a rotary shaft, the reel 3 under a state in which a fold f formed by doubling over the hose H is hooked to a hook bar 32B so that the hose H can be rolled up around the double-layer-roll core 3B while being looped around the projecting shaft 31B and the hook bar 32B, the projecting shaft 31B being provided to project from the double-layer-roll core 3B, the hook bar 32B being provided near and in parallel with the projecting shaft 31B; and providing an extended guide plate 30*b* to extend from the base plate 30 of the reel 3 so that the hose H can be rolled up by passing a hose guide 6 arranged on a front side of the frame unit 1 and then being led to the reel 3, with a side edge of the hose H being held in abutment with a surface of the extended guide plate 30*b*, tensioning the hose H in the front of the take-up device after the hose H has been taken up by a predetermined length and an outer circumference of a taken-up part of the hose H has become larger than unit circumferences of the wheels 2 and 2;

separating, when tension load equal to or more than a predetermined value is generated by the inherent weight or friction of a part of the hose H, the part having not yet been taken up, at least a part of a drive unit with use of a clutch mechanism or a torque limiter mechanism, to thereby interrupt transmission of the rotational torque of the wheels 2 with respect to the reel 3 so that a tensioned state of the hose H is cancelled; and taking up the tensioned hose H with tension equal to or smaller than a predetermined value. Thus, by also adopting the technical measure as described above, the method of taking up a fire-fighting hose can be completed.

Advantageous Effects of Invention

The present invention provides a take-up device for a fire-fighting hose, for taking up and restoring a long hose including couplers respectively arranged at both a leading end portion and a trailing end portion thereof, the take-up device including:

a wheel pivotably supported at a lower portion of a frame unit;

a handle arranged at an upper portion of the frame unit, the wheel being rotated to allow the frame unit to be transferred;

a rotatable reel provided to the frame unit and around which the hose is rolled up; and a transmission circulating member looped around a rotary shaft of the reel and a rotational support shaft of the wheel, in which the reel is rotatable in association with the rotation of the wheel, in which the reel includes a single-layer-roll core and a double-layer-roll core replaceable with each other, any one of the single-layer-roll core and the double-layer-roll core being capable of being removably fixed to a rotary-shaft portion of a base plate of the reel, in which the single-layer-roll core includes a holding member capable of pinching one of the couplers arranged at the end portions of the hose, the hose being capable of being rolled up around the single-layer-roll core by rotation of the reel, with the one of the couplers, which is pinched by the holding member, being a central axis, in which the double-layer-roll core includes a projecting shaft provided to project therefrom and a hook bar provided near and in parallel with the projecting shaft, the hose being capable of being rolled up around the double-layer-roll core while being looped around the projecting shaft and the hook bar by the rotation of the reel under a state in which a fold formed by doubling over the hose is hooked to the hook bar, with the projecting shaft being a rotary shaft, and in which an extended guide plate is provided to extend from the base plate of the reel, the hose being capable of being rolled up by passing a hose guide arranged on a front side of the frame unit and then being led to the reel, with a side edge of the hose being held in abutment with a surface of the extended guide plate.

Thus, with use of the take-up device for a fire-fighting hose according to the present invention, the hose can be quickly and reliably taken up in an upright posture with less effort. Thus, the take-up device has markedly high usability.

Further, the take-up device can be used for both the take-up methods for the hose: the single-layer rolling and the double-layer rolling. Thus, only by replacing the cores with each other, upon both a restoring operation after fire-fighting activities and an accommodating operation after washing, the hose can be taken up with use of the main unit of the same take-up device.

Still further, when necessary, on the rotary shaft of the reel, a large-diameter sprocket corresponding to the single-layer-roll core and a small-diameter sprocket corresponding to the double-layer-roll core may be removable to another end side of the rotary shaft, and those corresponding combinations may be distinguishable from each other. With this, a rotational speed of the wheel can be accorded with an increasing rate of a take-up diameter in each of the take-up methods. Therefore, even when the rotational speed of the wheel is uniform, a take-up speed is corrected and adjusted to the rotational speed, and hence both the take-up methods can be performed with high accuracy.

Yet further, when necessary, a protective cover may be mounted to an outer periphery of the coupler. With this, during the take-up operation, even when the coupler is dragged at the time of drawing the coupler in order to take up the hose, the coupler is prevented from being damaged.

Yet further, when necessary, a ratchet mechanism may be provided. With this, for example, the hose can be taken up by transmitting rotation to the rotary shaft when the main unit is moved forward, and idling can be performed when the main unit is moved backward. As a result, the hose can be taken up while eliminating looseness of the hose by moving the main unit forward and backward during the take-up operation. Further, the main unit can be pulled by gripping the handle during transportation of the taken-up hose.

Yet further, according to the take-up method of the present invention, the tensioned hose can be returned into a loose state and taken up, and hence a user can comfortably continue the take-up operation without feeling load or frictional resistance of the hose.

In this way, a draining operation and the take-up operation of the hose can be simultaneously performed, without the main body of the hose or the coupler being dragged. Thus, even when the hose is heavy itself and large in diameter, a restoring operation can be smoothly performed. Therefore, it can be said that the take-up device for a fire-fighting hose according to the present invention has markedly high usability and markedly high industrial utility value.

DESCRIPTION OF EMBODIMENT

Figure 1:
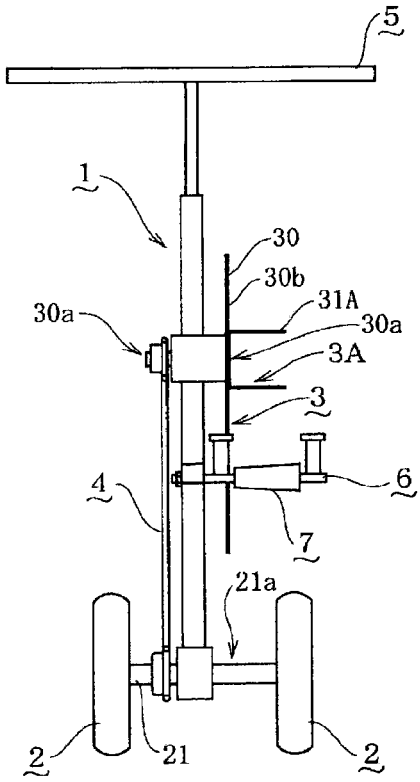
FIG. 1 An explanatory front view of a take-up device according to an embodiment of the present invention.
Figure 2:
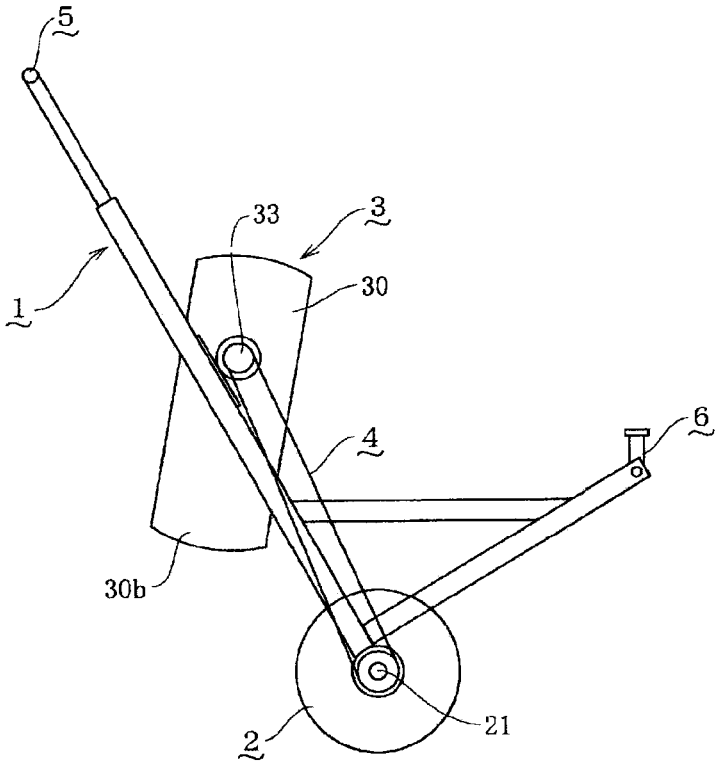
FIG. 2 An explanatory side view of the take-up device according to an embodiment of the present invention.
Figure 3:
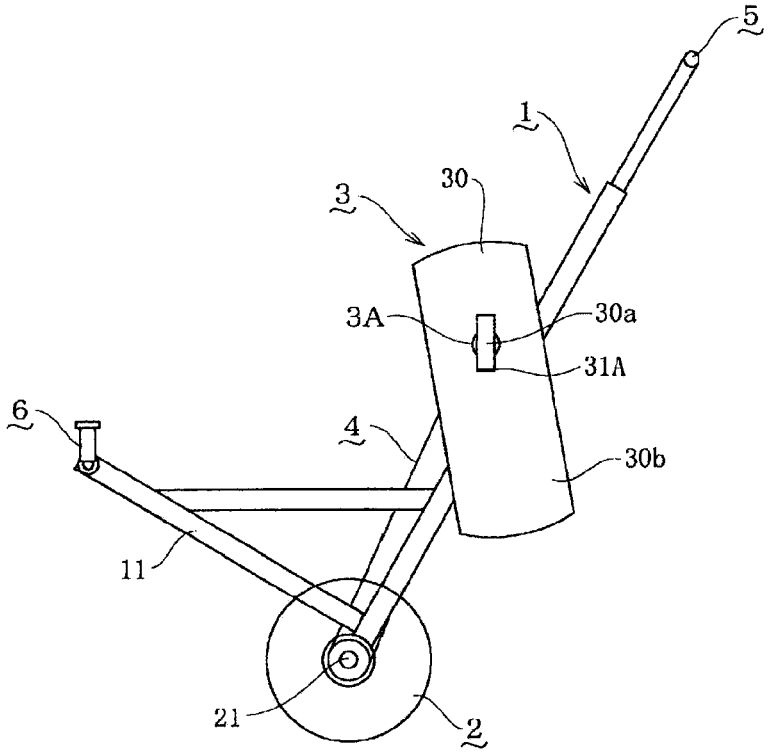
FIG. 3 Another explanatory side view of the take-up device according to an embodiment of the present invention.
Figure 4:
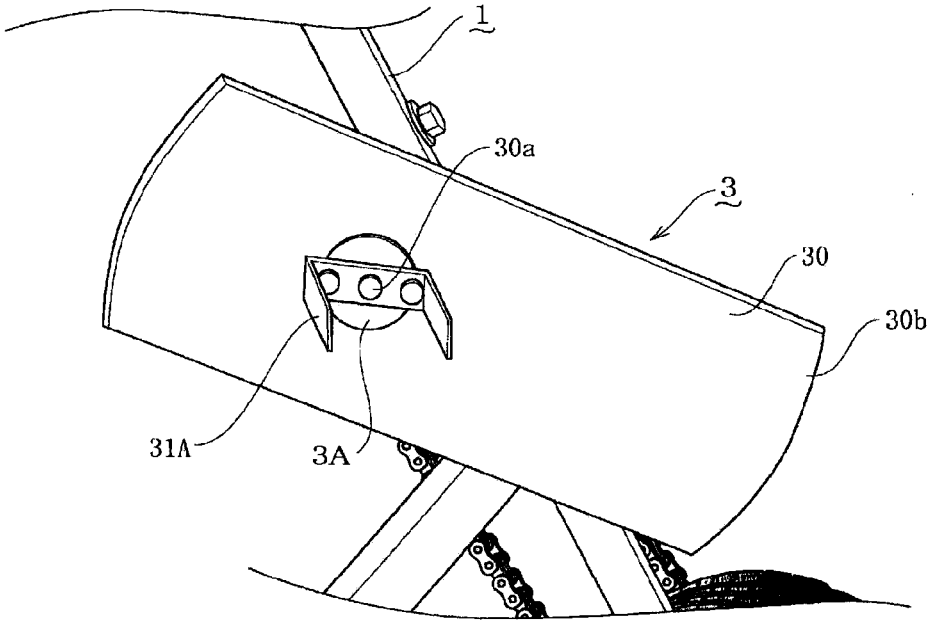
FIG. 4 An enlarged side view of a reel (single-layer rolling) according to an embodiment of the present invention.
Figure 5:
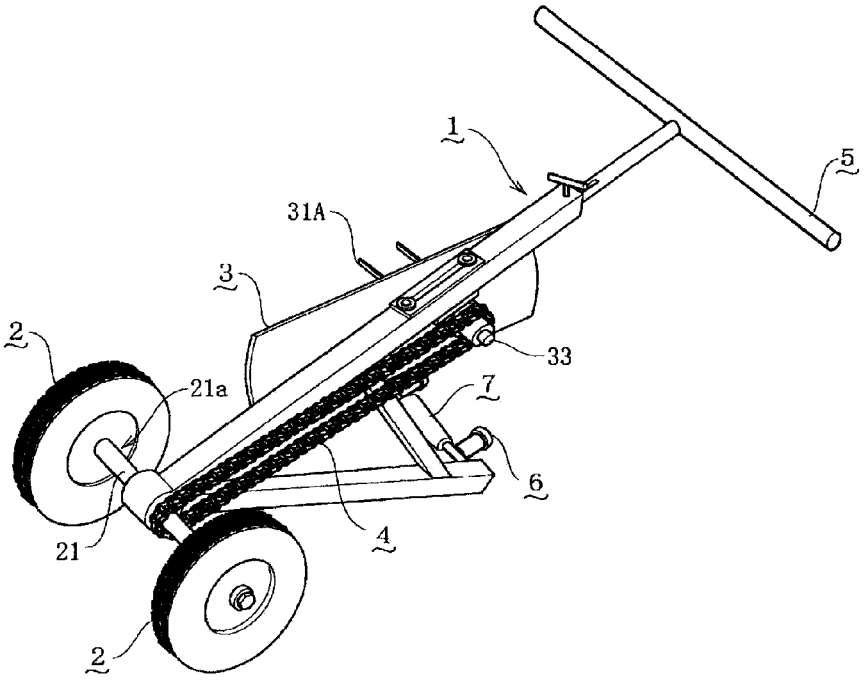
FIG. 5 An overall perspective view of the take-up device according to an embodiment of the present invention.

In the following, more detailed description is made of a mode for carrying out the present invention with reference to the specific drawings.

Description is made of an embodiment of the present invention with reference to FIGS. 1 to 24. In the figures, a frame unit is denoted by reference numeral 1. The frame unit 1 is formed by setting a framework of steel bar members and then uniting the bar members by welding or the like.

Further, a pair of left and right wheels are denoted by reference numeral 2. Those wheels 2 are formed by mounting rubber tires to wheels, the rubber tires being excellent in cushioning properties with respect to unevenness of a road surface. The two wheels 2 and 2 are coupled to each other by a rotational support shaft 21.

In this embodiment, the set of two wheels 2 and 2 are arranged left and right in pairs. Thus, upon turning or during transportation, the traveling direction of a take-up device can be smoothly switched by using those wheels as fulcrums. As a result, usability can be enhanced.

Still further, a reel is denoted by reference numeral 3. The reel 3 is a member for rolling up a hose, and includes at least one of a single-layer-roll core 3A and a double-layer-roll core 3B replaceable with each other.

Yet further, a transmission circulating member is denoted by reference numeral 4. In this embodiment, the transmission circulating member 4 employs a transmission mechanism formed of a chain and sprockets. However, any annular member capable of transmitting rotational torque, such as a rubber flat belt, can be employed as the transmission circulating member.

The present invention provides a device for taking up and restoring a long hose H having couplers C (water discharge fittings) respectively arranged at both leading and trailing end portions. In the structure of the take-up device, the wheels 2 are pivotably supported at a lower portion of the frame unit 1 and a T-shaped handle 5 is arranged at an upper portion thereof. With this, by rotation of the wheels 2, the frame unit 1 can be moved (refer to FIGS. 1 to 3).

Next, the frame unit 1 is provided with the rotatable reel 3 for rolling up the above-mentioned hose H. The transmission circulating member 4 is looped around a rotary shaft 33 of the reel 3 and the rotational support shaft 21 of the wheels 2, and the reel 3 is rotated in association with rotation of the wheels 2. In this embodiment, the sprockets (gears) are fixed respectively to the rotary shaft 33 of the reel 3 and the rotational support shaft 21 of the wheels 2, and a chain member is looped therearound to mesh with those sprockets.

In this context, the reel 3 includes at least one of the single-layer-roll core 3A and the double-layer-roll core 3B replaceable with each other. Any one of the single-layer-roll core 3A and the double-layer-roll core 3B is removably fixed to a rotary-shaft portion 30*a* of a base plate 30 of the reel 3. In this embodiment, the rotary-shaft portion 30*a* is provided at one point on the base plate 30. Meanwhile, the rotary shaft 33 is provided to project from a rear surface of each of the cores, and the rotary shaft 33 of each of the cores can be passed through a hole portion of the rotary-shaft portion 30*a* of the base plate 30, and the sprocket can be mounted to a leading end side of the rotary shaft 33. Note that, the rotary-shaft portion 30*a* may be provided at two points on the reel so that the single-layer-roll core 3A and the double-layer-roll core 3B are respectively fastened.

<<Single-Layer Rolling of the Hose>>

First, description is made of a case of restoring the hose H by single-layer rolling. The single-layer rolling is mainly performed immediately after fire-fighting activities on site. Specifically, the single-layer-roll core 3A of the reel 3 is provided with a holding member 31A capable of pinching the coupler C of the above-mentioned hose H. In this embodiment, the holding member 31A is formed of a pair of elastic plate bodies arranged to face each other (refer to FIGS. 4 and 5).

Figure 6:
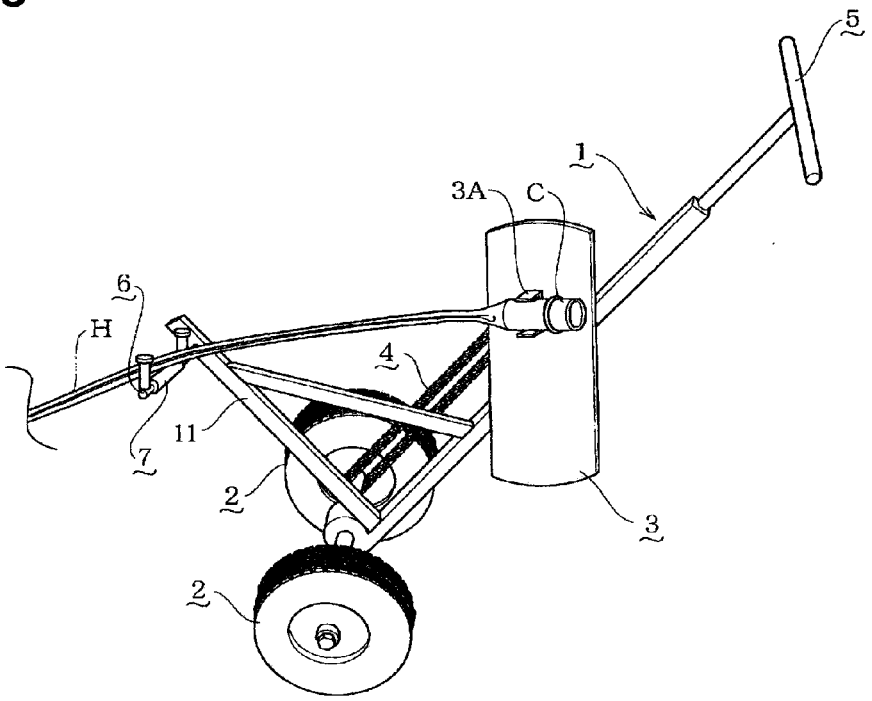
FIG. 6 An overall perspective view illustrating a use state of the take-up device according to an embodiment of the present invention.
Figure 7:
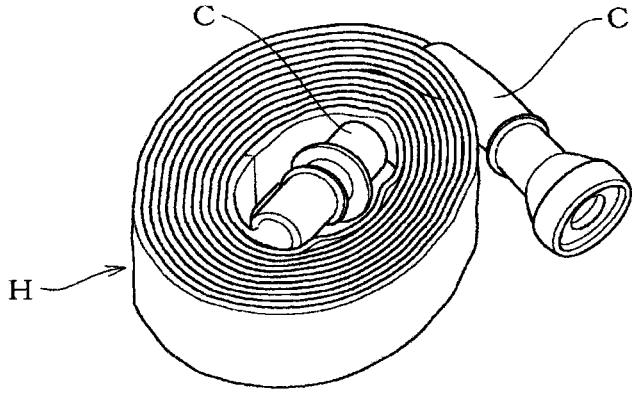
FIG. 7 A perspective view of a hose taken up by single-layer rolling according to an embodiment of the present invention.

As illustrated in FIG. 6, the reel 3 is rotated in association with the rotation of the wheels 2 caused by traveling of the frame unit 1. As a result, the hose H is taken up around the coupler C as a central axis, which is pinched by the holding member 31A (refer to FIG. 7).

In this embodiment, a ratchet mechanism for transmitting rotation only in one direction of the wheels 2 to the reel 3 can be provided. When the frame unit 1 is moved forward, the hose H is taken up by transmission of the rotation of the wheels 2 with respect to the reel 3, and when the frame unit 1 is moved backward (pulled), the hose H remains stopped by idling of the ratchet mechanism. Thus, a transporting operation is facilitated.

Further, in this embodiment, an extended guide plate 30*b* is provided to extend from the base plate 30 of the reel 3. The hose H that has passed a hose guide 6 arranged on a front side of the frame unit 1 is led to the reel 3 by the extended guide plate 30*b*, and neatly taken up by the reel 3, with a side edge of the hose H being held in abutment with a surface of the extended guide plate 30*b*.

Still further, in this embodiment, the frame unit 1 is provided with a tapered leading inclined member 7 for bringing the hose H that has passed the hose guide 6 toward the extended guide plate 30*b* side.

Note that, in this embodiment, a protective cover may be appropriately mounted in case the coupler C is dragged when being taken up.

Figure 8:
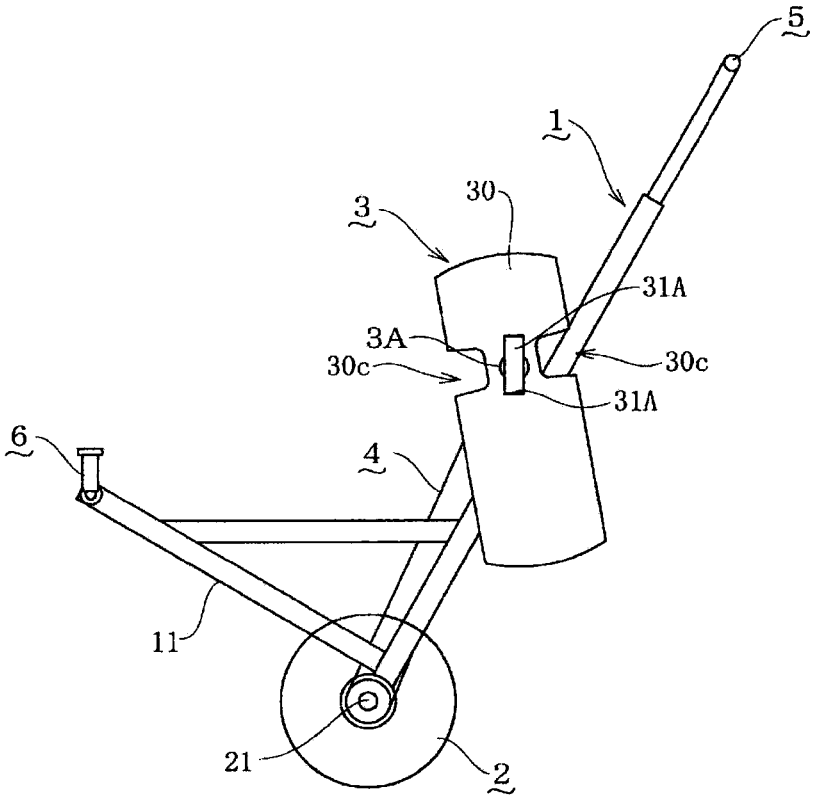
FIG. 8 A perspective view illustrating a modification of an embodiment of the present invention.
Figure 9:
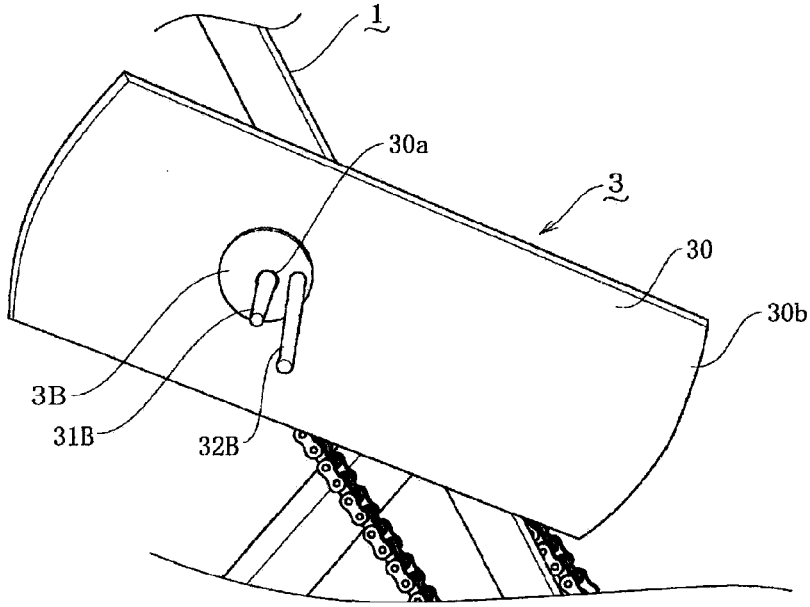
FIG. 9 An enlarged side view of the reel (double-layer rolling) according to an embodiment of the present invention.

Yet further, in this embodiment, a pair of recessed portions 30*c* and 30*c* are formed by the side of the rotary-shaft portion 30*a* of the base plate 30 of the reel 3 so that the taken-up hose H can be easily removed by fitting fingers into those recessed portions 30*c* and 30*c* (refer to FIG. 8).

<<Double-Layer Rolling of the Hose>>

Next, description is made of a case of restoring the hose H by double-layer rolling. The double-layer rolling is performed mainly at the time of preparing a washed hose for next use. Specifically, a projecting shaft 31B is provided to project from the double-layer-roll core 3B of the reel 3, and a hook bar 32B is arranged by the side of and in parallel with the projecting shaft 31B (refer to FIG. 9).

Figure 10:
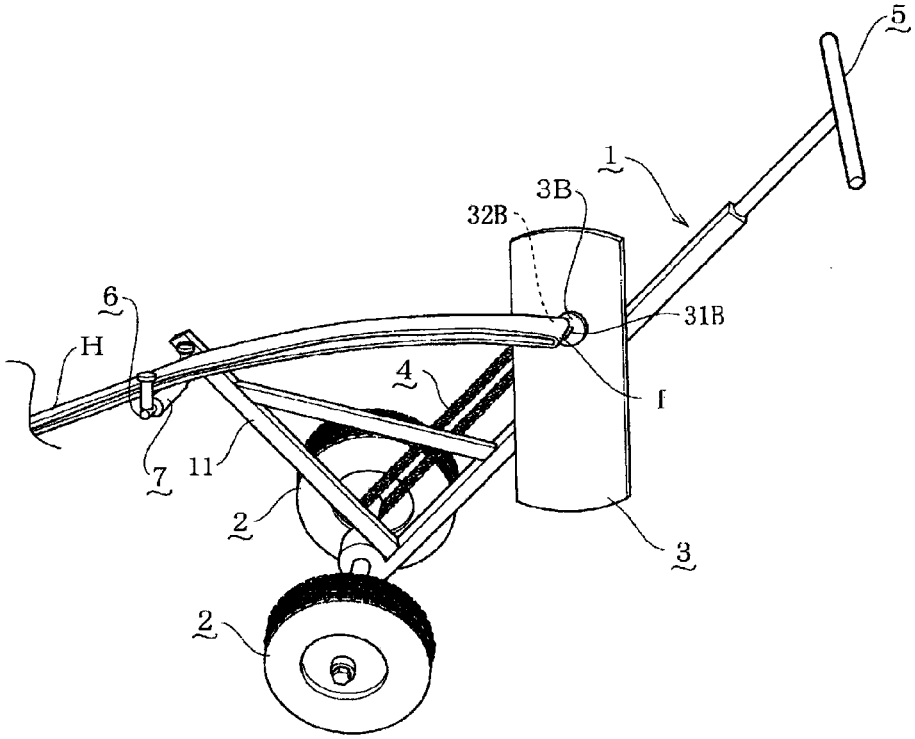
FIG. 10 An overall perspective view illustrating another use state of the take-up device according to an embodiment of the present invention.

Then, a fold f formed by doubling over the hose H is hooked to the hook bar 32B (refer to FIG. 10). After that, by rotating the reel 3, the hose H is taken up around the projecting shaft 31B as a rotary shaft in a state of being looped around the projecting shaft 31B and the hook bar 32B.

Figure 11:
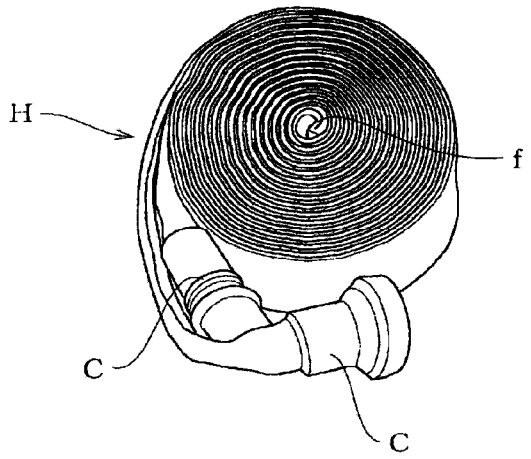
FIG. 11 A perspective view of the hose taken up by double-layer rolling according to an embodiment of the present invention.

In this embodiment, the hook bar 32B of the double-layer-roll core 3B mounted to the reel 3 is formed in a tapered shape that tapers toward the leading end so that the taken-up hose H can be easily pulled out. In other words, in the case of the double-layer rolling, the hose looped around the projecting shaft 31B and the hook bar 32B is rolled therearound in a tensioned state. However, the distance between the shaft and the bar is smaller toward the leading end of the tapered part of the hook bar 32B. Thus, when the hose is pulled away from the base plate 30 a perpendicular direction, the hose H can be easily pulled out. After that, as illustrated in FIG. 11, the hose H can be taken up by double-layer rolling.

Further, in this embodiment, both in the cases of single-layer rolling and double-layer rolling, it is also possible to provide a slip mechanism (differential device) for controlling to reduce the speed transmitted by the rotation of the wheels 2 and transmitting same to the reel 3. Specifically, a clutch plate is arranged at a torque transmission part so that the reel 3 idles when the rotational speed of the wheel is high. In addition, with use of a planetary roller, the rotational speed of the reel 3 may be controlled to increase and decrease in association with an increase and decrease of the diameter of the taken-up part of the hose. In this way, the traveling speed of the take-up device and the take-up speed for the hose can be linked to each other. As a result, it is no longer necessary to replace two types of the sprockets, and the coupler C is prevented from being dragged during a take-up operation.

Still further, in this embodiment, it is possible to provide a clutch mechanism in which at least a part of a drive unit thereof is separable. By causing idling between the wheels 2 and the reel 3 with the clutch mechanism, transmission of the rotational torque of the wheels 2 with respect to the reel 3 can be manually interrupted/established.

Specifically, this torque limiter mechanism detects tension load equal to or more than a predetermined value generated by the inherent weight or friction of a part of the hose H which has not yet been taken up, and separates at least a part of the drive unit. In this way, transmission of the rotational torque of the wheels 2 with respect to the reel 3 can be interrupted by spinning.

For example, when a tension load equal to or more than a predetermined value is applied, a movable pops up projecting portion (inserted hard ball) which is provided in a clutch joint surface of a plate body and a recessed portion on another surface side are disengaged from each other. In this way, the transmission of the rotational torque can be interrupted.

Further, the handle 5 may be provided with an operation lever. By gripping the operation lever, the drive unit including the clutch plate coupled by a wire or the like is separated. In this way, the transmission of the rotational torque of the wheels 2 to the reel 3 can be interrupted.

Figure 12:
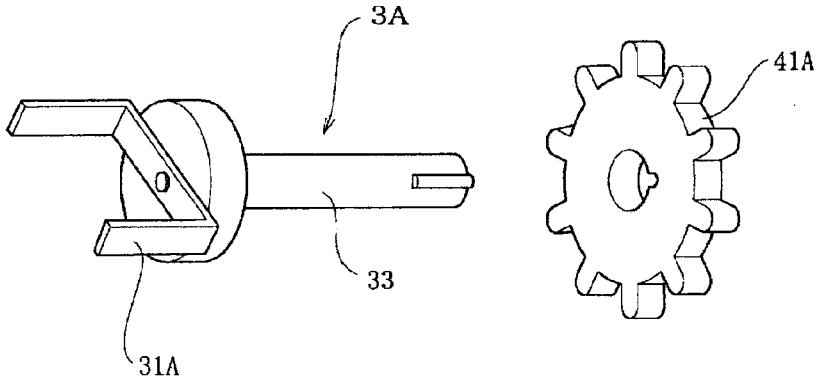
FIG. 12 An exploded perspective view of a structure of a single-layer-roll core according to an embodiment of the present invention.
Figure 13:
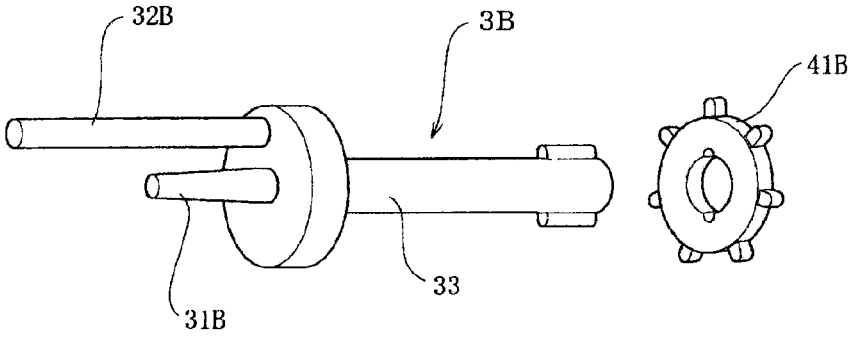
FIG. 13 An exploded perspective view of a structure of a double-layer-roll core according to an embodiment of the present invention.

Note that, in this embodiment, for example, as illustrated in FIGS. 12 and 13, on the rotary shaft 33 of the reel 3, a large-diameter sprocket 41A corresponding to the single-layer-roll core 3A and a small-diameter sprocket 41B corresponding to the double-layer-roll core 3B can each be made removable to another end side of the rotary shaft 33 and those corresponding combinations can be made distinguishable from each other. As distinguishing means therefor, cross-sections of the shaft portions for the fitting can be made different (for example, modified cross-section or polygonal cross-section) from each other.

Still further, in this embodiment, the rotational support shaft 21 of the wheels 2 is provided with a step portion 21*a*. By placing a foot on the step portion 21*a* so that the wheels 2 are fixed, and putting down the handle 5 about the rotational support shaft 21 as a rotary shaft, the hose guide 6 can be raised about the wheels 2 as a fulcrum (refer to FIG. 5).

Figure 14:
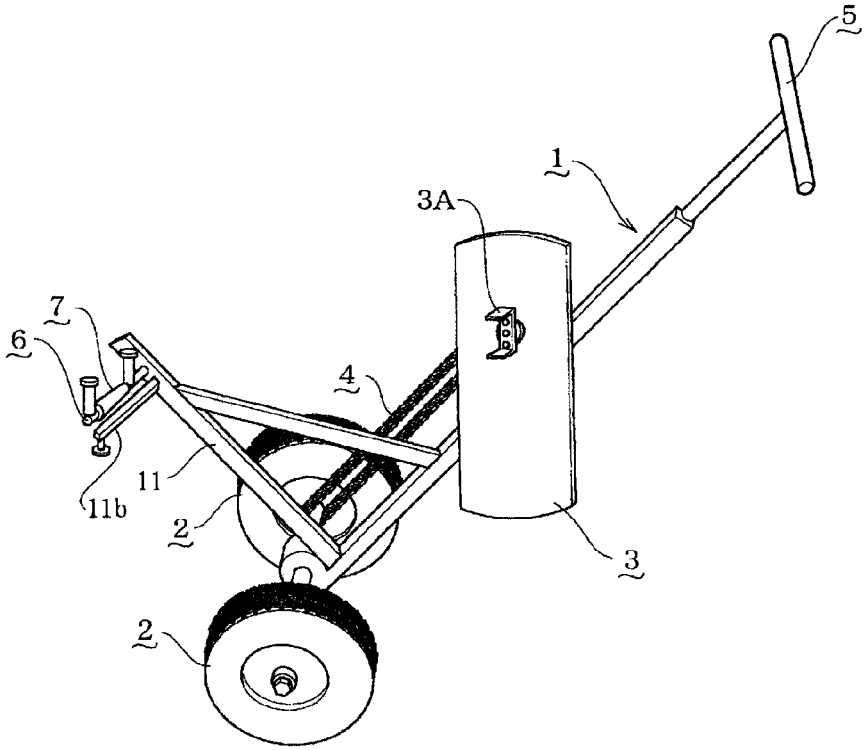
FIG. 14 A perspective view illustrating another modification of the take-up device according to an embodiment of the present invention.
Figure 15:
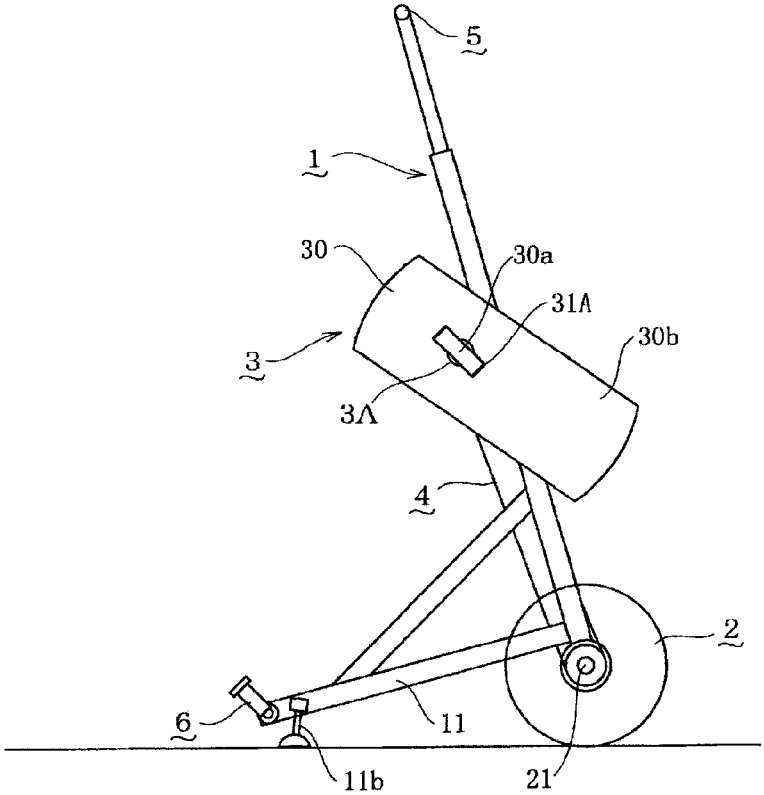
FIG. 15 An explanatory side view illustrating the other modification of the take-up device according to an embodiment of the present invention.

Yet further, in this embodiment, as illustrated in FIGS. 14 and 15, a stand member 11*b* may be provided at a leading end of a beam portion 11 of the frame unit 1. By landing the stand member 11*b*, for example, when the take-up device is not used, the frame unit 1 can be stably placed (refer to FIG. 15).

Next, in the following, description is made of modifications of this embodiment, and a specific take-up procedure by the take-up device according to those modifications. In the take-up step, as the hose H is further taken up, a length of the hose H rolled per unit rotation of the wheels increases in proportion to an outer circumference of the taken-up part of the hose H. Thus, a difference between those lengths causes a residual part of the hose H, which has not yet been restored and lying on the ground, to be dragged in some cases, which may lead to a risk of damaging the textile of the hose H and the coupler C at the leading end. Thus, it is necessary to overcome such failures.

Specifically, the wheels 2 and 2 are formed of a free wheel 2A rotatably and pivotably supported and an associative wheel 2B coupled to the transmission circulating member 4 so that rotational torque of the wheels can be transmitted, which are provided at respective end portions of the rotational support shaft 21.

Figure 16:
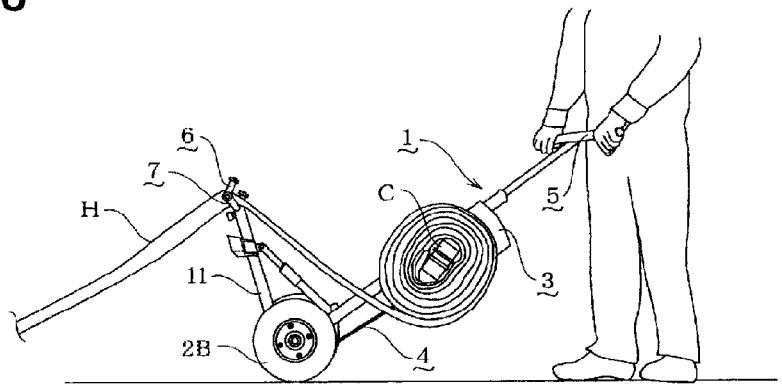
FIG. 16 An explanatory side view illustrating a procedure of a take-up method according to an embodiment of the present invention.

After the hose H has been taken up by a predetermined length and the outer circumference of the taken-up part of the hose H has become larger than unit circumferences of the wheels 2A and 2B, as illustrated in FIG. 16, the hose H starts to be tensioned in the front of the take-up device.

Figure 17:
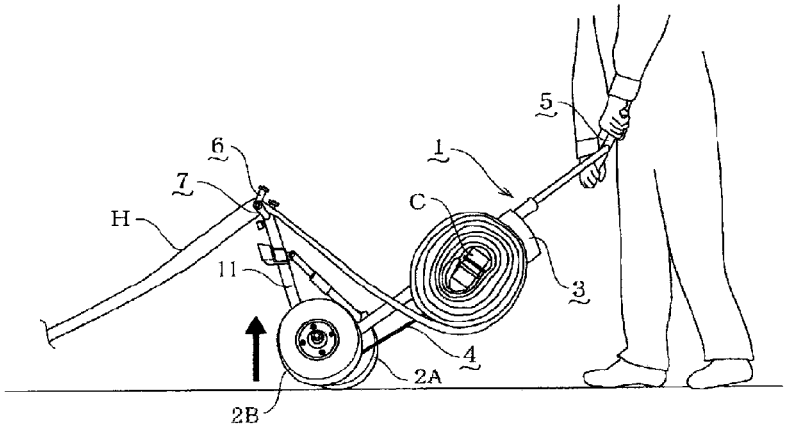
FIG. 17 Another explanatory side view illustrating the procedure of the take-up method according to an embodiment of the present invention.
Figure 18:
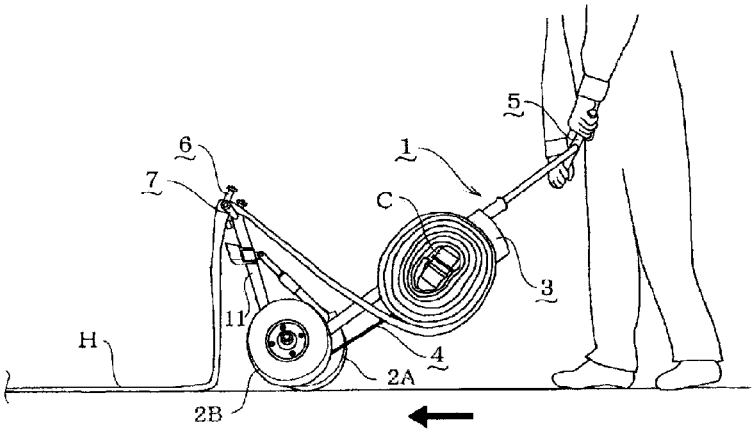
FIG. 18 Still another explanatory side view illustrating the procedure of the take-up method according to an embodiment of the present invention.

Next, as illustrated in FIG. 17, under a state in which the free wheel 2A rotatably and pivotably supported by the rotational support shaft 21 is grounded, the opposite associative wheel 2B is lifted off.

Next, the take-up device is moved forward as it is. Then, the take-up operation by the reel 3 is temporarily stopped, and hence the tensioned state of the hose H can be cancelled (refer to FIG. 18).

After that, by grounding the associative wheel 2B and moving forward the take-up device again, the take-up operation for the hose H can be restarted. In this way, the tensioned hose H can be returned into a loose state and taken up, and hence a user can comfortably continue the take-up operation without feeling load or frictional resistance of the hose H.

In this way, in the present invention, a draining operation and the take-up operation for the hose H can be simultaneously performed, and the main body of the hose H or the coupler C is not dragged. Thus, even when the hose H is heavy itself and large in diameter, a restoring operation can be smoothly performed.

Figure 19:
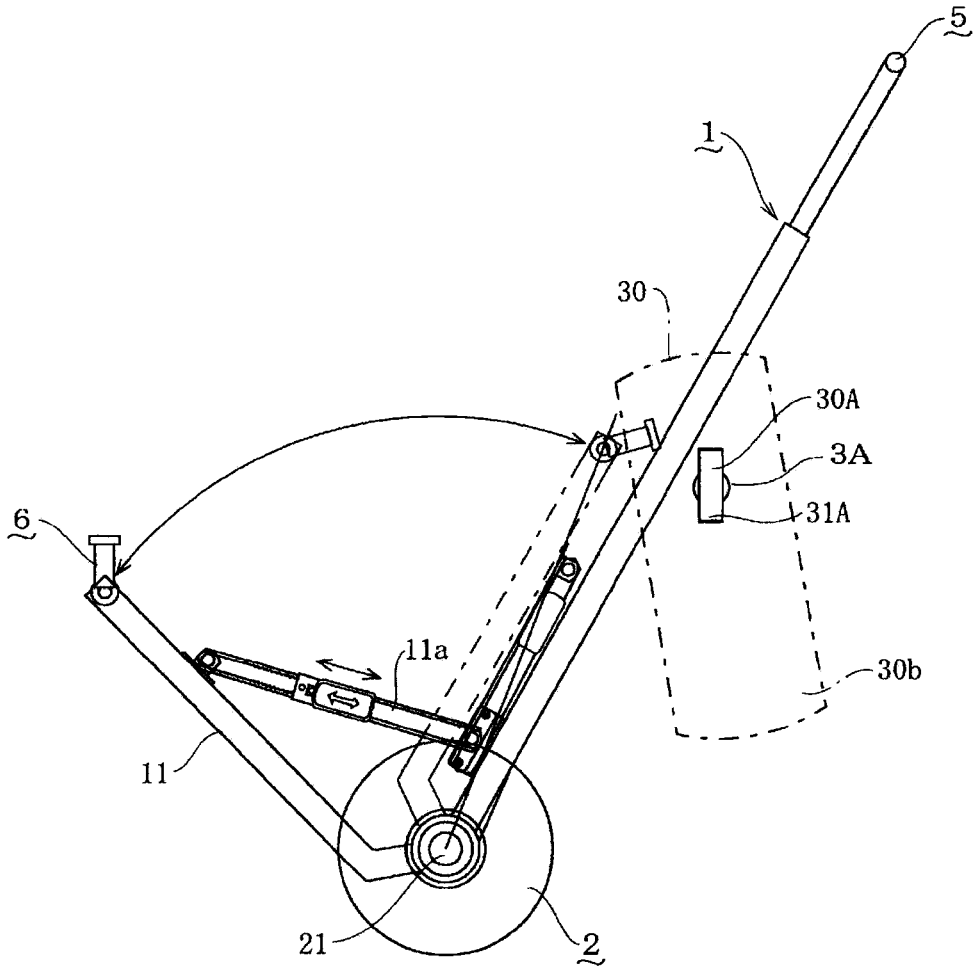
FIG. 19 An explanatory side view illustrating still another modification of the take-up device according to an embodiment of the present invention.

Although being structured basically as described above, the present invention is not limited to the illustrated embodiment, and various changes can be made within the scope of the Claims. For example, as illustrated in FIG. 19, the beam portion 11 arranged on the front side of the frame unit 1 may be provided with a stretching mechanism 11*a*. In this way, a foldable structure can be obtained, and hence the take-up device can be compactly accommodated during non-use or transportation. In this case, the stretching mechanism 11*a* may be provided with a lock mechanism so that safety can be enhanced.

Further, the beam portion 11 of the frame unit 1 is not necessarily extendable, and may be disassembled and removed so that the frame unit 1 becomes compact.

Figure 20:
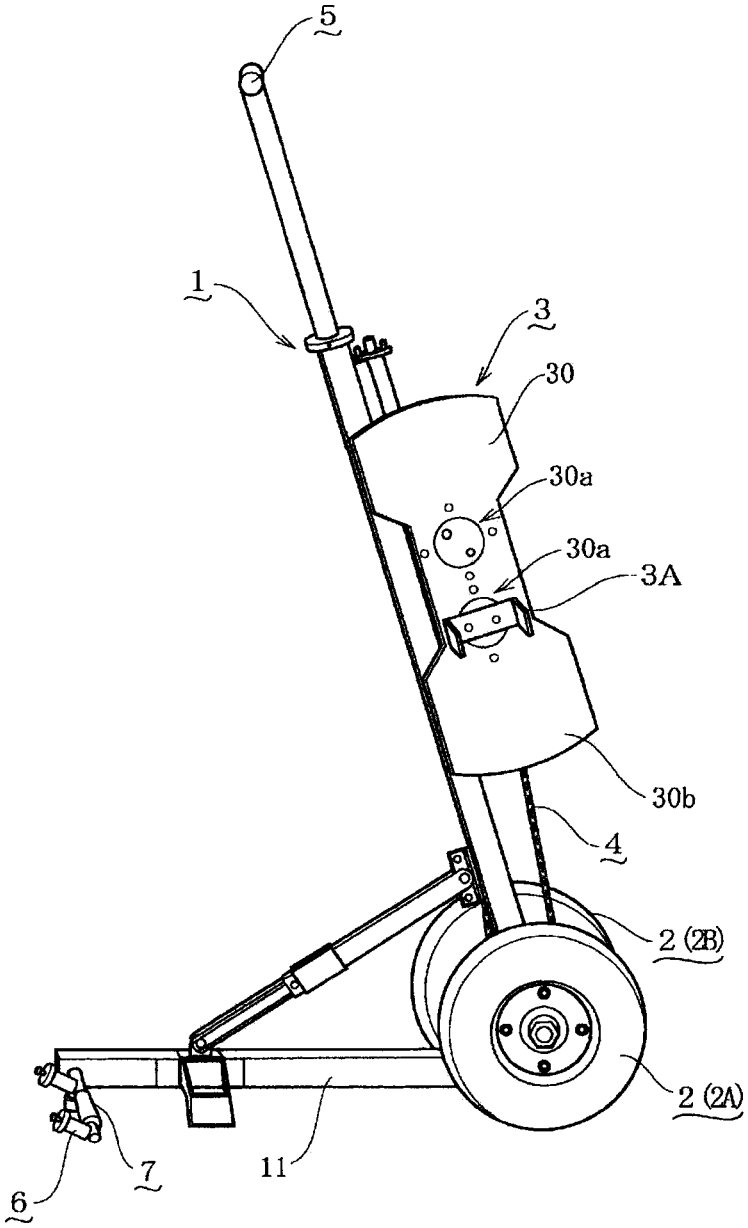
FIG. 20 An explanatory side view illustrating the still other modification of the take-up device according to an embodiment of the present invention.

Still further, in this embodiment, as illustrated in FIG. 20, a rotary-shaft portion 30*a* may be provided at two points on the base plate 30 of the reel 3. In this case, the single-layer-roll core 3A and the double-layer-roll core 3B can be fixed respectively to the rotary-shaft portions 30*a*.

Figure 21:
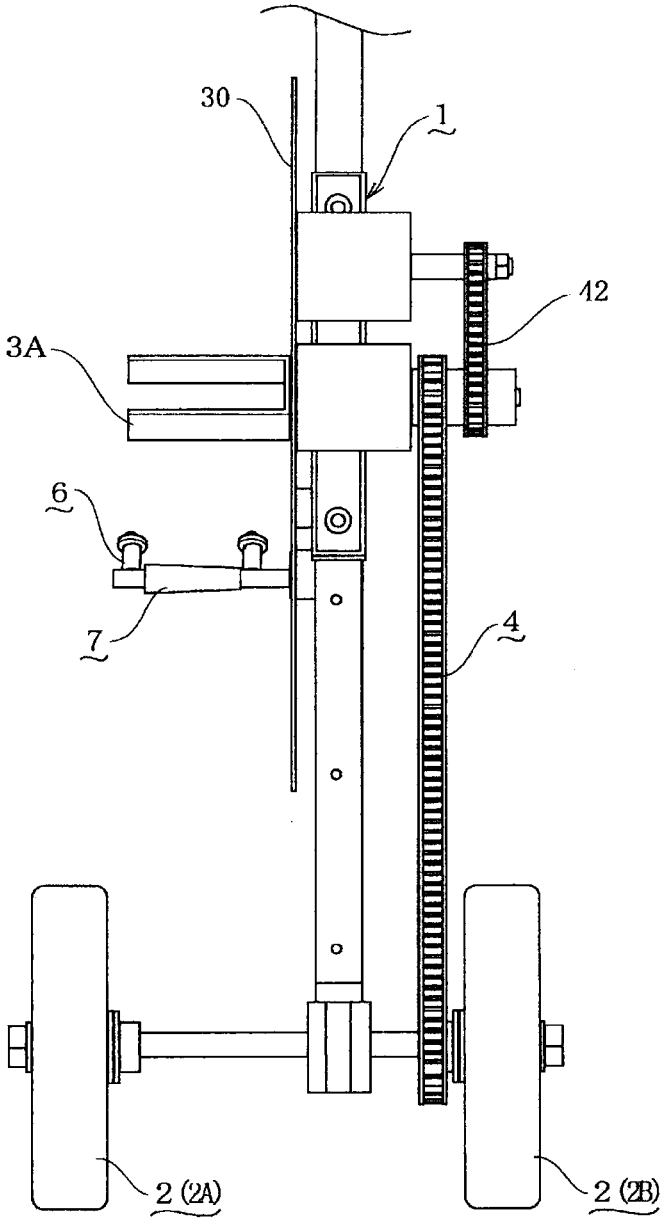
FIG. 21 An explanatory perspective view illustrating the still other modification of the take-up device according to an embodiment of the present invention.

Note that, as illustrated in FIG. 21, on the rear surfaces of the rotary-shaft portions 30*a*, a link member 42 is looped around the rotary shafts 33 and 33 of the single-layer-roll core 3A and the double-layer-roll core 3B. Thus, both the rotary shafts can be coupled to each other so as to be rotated in a linked manner.

Figure 22:
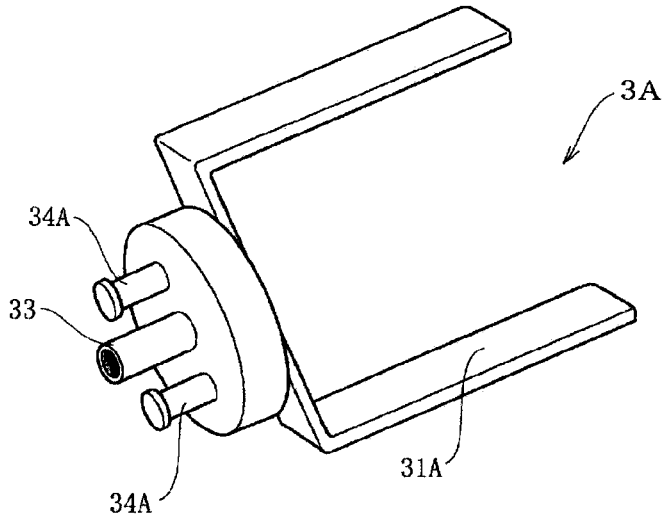
FIG. 22 An explanatory side view illustrating a modification of the single-layer-roll core according to an embodiment of the present invention.
Figure 23:
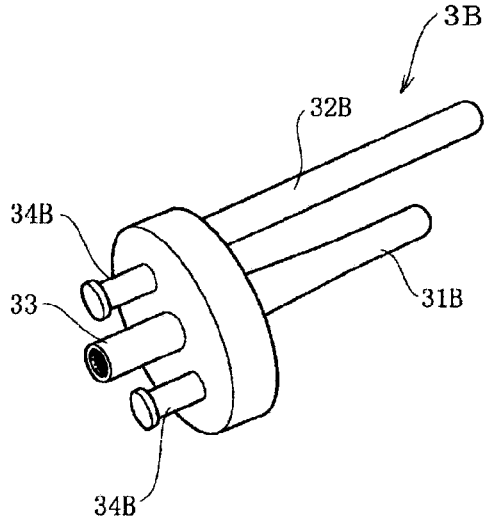
FIG. 23 An explanatory side view illustrating a modification of the double-layer-roll core according to an embodiment of the present invention.
Figure 24:
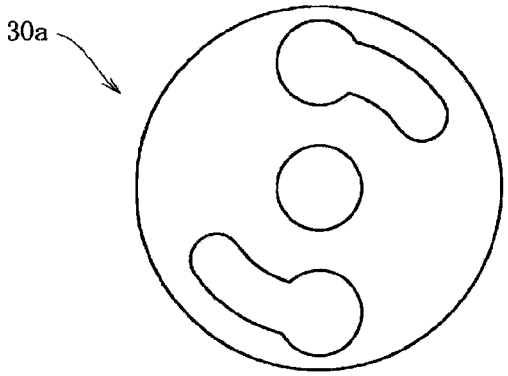
FIG. 24 An explanatory side view illustrating a modification of a take-up device according to an embodiment of the present invention.

Yet further, in this embodiment, as illustrated in FIGS. 22 and 23, when the single-layer-roll core 3A and the double-layer-roll core 3B are mounted to the base plate 30, in addition to the provision of the rotary-shaft portions 30*a* and 30*a* capable of respectively fixing the single-layer-roll core 3A and the double-layer-roll core 3B, the rotary-shaft portions 30*a* of the base plate 30 are provided with a plurality of hole portions (refer to FIG. 24). Meanwhile, engaging projecting portions 34A and 34A (34B and 34B) and the rotary shafts 33 are provided to project from respective rear surfaces of the single-layer-roll core 3A and the double-layer-roll core 3B. The engaging projecting portions and the rotary shafts can be fitted into the rotary-shaft portions 30*a*. In this case, the rotary shaft 33 is inserted into the center of the rotary-shaft portion 30*a*, and the engaging projecting portions 34A and 34A (34B and 34B) are engaged by rotation into the elongated arc-shaped holes provided through the rotary-shaft portion 30*a* (refer to FIG. 24). In this way, fixing by fastening in a bayonet style is possible. All of the above-mentioned matters also belong to the technical scope of the present invention.

REFERENCE SIGNS LIST

1 frame unit
11 beam portion
11*a* stretching mechanism
11*b* stand member
2 wheel
2A associative wheel
2B free wheel
21 rotational support shaft
21*a* step portion
3 reel
30 base plate
30*a* rotary-shaft portion
30*b* extended guide plate
30*c* recessed portion
33 rotary shaft
3A single-layer-roll core
31A holding member
34A engaging projecting portion
3B double-layer-roll core
31B projecting shaft
32B hook bar
34B engaging projecting portion
4 transmission circulating member
41A, 41B sprocket
42 link member
5 handle
6 hose guide
7 leading inclined member
H hose
C coupler
f fold

The invention claimed is:

1. A method of taking up a fire-fighting hose, in which a long hose including couplers respectively arranged at both a leading end portion and a trailing end portion thereof is taken up and restored, the method comprising:

pivotably supporting a pair of wheels at ends of a rotational support shaft at a lower portion of a frame unit, the wheels respectively comprising a free wheel rotatably and pivotably supported and an associative wheel coupled to a transmission circulating member so that rotational torque of the wheels can be transmitted, the free wheel being free to rotate relative to the rotational support shaft;

pushing and drawing a handle arranged at an upper portion of the frame unit so that the wheels are rotated and the frame unit can be moved;

providing, to the frame unit, a rotatable reel around which the hose is rolled up;

looping the transmission circulating member around a rotary shaft of the reel and the rotational support shaft of the associative wheel, the reel being rotatable in association with the rotation of the associative wheel;

removably fixing one of a single-layer-roll core and a double-layer-roll core to a rotary-shaft portion of a base plate of the reel, the single-layer-roll core and the double-layer-roll core being replaceable with each other on the rotary-shaft portion of the base plate of the reel;

when the single-layer roll core is removably fixed to the rotary-shaft portion of the base plate of the reel, rotating the reel so that the hose can be rolled up around the single-layer-roll core, with one of the couplers arranged at the end portions of the hose being a central axis, the one of the couplers being pinched by a holding member provided to the single-layer-roll core and capable of pinching the one of the couplers;

when the single-layer roll core is removably fixed to the rotary-shaft portion of the base plate of the reel, rotating the reel under a state in which a fold formed by doubling over the hose is hooked to a hook bar so that the hose can be rolled up around the double-layer-roll core while being looped around a projecting shaft and the hook bar, the projecting shaft being provided to project from the double-layer-roll core, the hook bar being provided near and in parallel with the projecting shaft; and providing an extended guide plate to extend from the base plate of the reel so that the hose can be rolled up by passing a hose guide arranged on a front side of the frame unit and then being led to the reel, with a side edge of the hose being held in abutment with a surface of the extended guide plate, tensioning the hose in the front of the take-up device after the hose has been taken up by a predetermined length and an outer circumference of a taken-up part of the hose has become larger than unit circumferences of the wheels;

lifting off the associative wheel under a state in which the opposite free wheel rotatably and pivotably supported by the rotational support shaft is grounded;

temporarily stopping take-up operation performed by the reel after moving forward the take-up device in a lift-off state so that a tensioned state of the hose is cancelled; and after the temporarily stopping, grounding the associative wheel and moving forward the take-up device again, to thereby take up the hose.

* * * * *